US006047570A

United States Patent [19]

Shima

[11] Patent Number: 6,047,570

[45] Date of Patent: Apr. 11, 2000

[54] YARN FEEDING SYSTEM FOR A FLAT KNITTING MACHINE RELEASIBLY ENGAGED WITH RECIPROCATING SHIFTING MEMBERS

[75] Inventor: Masahiro Shima, Wakayama, Japan

[73] Assignee: Shima Seiki Manufacturing, Ltd., Wakayama, Japan

[21] Appl. No.: 09/059,383

[22] Filed: Apr. 14, 1998

[30] Foreign Application Priority Data

Apr. 15, 1997 [JP] Japan ..... 9-097209

[51] Int. Cl.[7] ..... D04B 15/30; D04B 15/48; D04B 15/56

[52] U.S. Cl. ..... 66/126 R; 66/64

[58] Field of Search ..... 66/126 R, 128, 66/64

[56] References Cited

U.S. PATENT DOCUMENTS 3,691,794 9/1972 Jeffcoat ..... 66/126 R
4,354,363 10/1982 Inoue .
4,909,048 3/1990 Stoll et al. .
5,020,341 6/1991 Schimko ..... 66/126 R
5,031,423 7/1991 Ikenaga .
5,588,311 12/1996 Kiribuchi .

*Primary Examiner*—Andy Falik
*Attorney, Agent, or Firm*—Nikaido, Marmelstein, Murray & Oram LLP

[57] ABSTRACT

A yarn feeding system of a flat knitting machine having needle beds. Each needle bed having a plurality of needles. A plurality of yarn carrier rails extend in parallel to the needle beds in a longitudinal direction of the needle beds. A cam carriage reciprocates over the needle beds while yarn carriers caught/released by a yarn carrier catcher mounted on the cam carriage travels on a yarn carrier rail to feed yarn to the needles of the needle beds. The yarn feeding system has shifting members that extend along and in the longitudinal direction of the yarm carrier rails. A shifter reciprocally shifts the shifting members in the longitudinal direction of the yarn carriers. An engager engages the yarn carriers to the shifting members such that the yarn carriers are disengaged and released from the shifting members when catching and carrying is affected by the catcher.

11 Claims, 9 Drawing Sheets

YARN FEEDING SYSTEM FOR A FLAT KNITTING MACHINE RELEASIBLY ENGAGED WITH RECIPROCATING SHIFTING MEMBERS

FIELD OF THE INVENTION

The present invention relates to a yarn feeding system that reciprocates over needle beds of a flat knitting machine to feed yarn to needles of the beds.

PRIOR ART

There are yarn feeding systems of flat knitting machines wherein a cam carriage is driven by a servomotor and a yarn carrier is driven by another servomotor to travel on a yarn carrier rail (Japanese Patent Hei 3-62821 and Japanese Provisional Patent Hei 8-127948). In the yarn feeding systems of these flat knitting machines, an endless toothed belt is put over pulleys provided at both ends of the yarn carrier rail, and one end of a yarn carrier is fixed to the toothed belt. The belt is driven, via a pulley, by the servomotor to slide the yarn carrier sidewise along the yarn carrier rail. With these yarn feeding systems, the yarn carrier can be made to stand by at any desired position over the needle beds. These yarn feeding systems have a big merit that dead times for fetching a yarn carrier with a cam carriage and for small moves of the carrier such as so-called kick backs" are eliminated.

On the other hand, in knitting stitch loops by moving needles forward and backward, according to Japanese Patent Hei 3-62821, the motor for driving a belt for a yarn carrier and the motor for driving a belt for a cam carriage are completely synchronized with each other. According to Japanese Provisional Patent Hei 8-127948, a yarn carrier is caught and carried by a means for catching and carrying a yarn carrier, said means being mounted on a cam carriage and comprising catching pins driven vertically by solenoids. During the catching and carrying, the servomotor output on the yarn carrier side is electrically regulated below the rated output to eliminate the need of synchronous control of the yarn carrier and the carriage, and at the same time to eliminate the control error that is generated when the yarn carrier and the cam carriage are to be synchronized completely.

In both yarn feeding systems mentioned above, it is necessary to control the servomotor of the yarn carrier, through synchronous control or electric control, during a knitting operation when the yarn carrier travels together with the cam carriage.

SUMMARY OF THE INVENTION

One objective of the present invention is to provide a yarn feeding system of a flat knitting machine, that does not require the above-mentioned complicated control when the yarn carrier is caught and carried by a catching pin of a cam carriage.

The present invention is a yarn feeding system of a flat knitting machine comprising needle beds with many needles, yarn carrier rails extending in parallel to said needle beds and in the longitudinal direction of said needle beds, a cam carriage reciprocating over said needle beds, and yarn carriers that are caught/released by yarn carrier catching means being mounted on said cam carriage to travel on a yarn carrier rail to feed yarn to needles of said needle beds, said yarn feeding system being characterized by being provided with shifting members extending in the longitudinal direction of the yarn carrier rails, shifting means for reciprocally shifting said shifting members in the longitudinal direction of the yarn carrier rails, and engaging means for moving yarn carriers through shifting of the shifting member, said engaging means allowing the yarn carrier to move relative to the shifting member when catching and carrying is effected by said catching means. With these arrangements, when a shifting member shifts in the longitudinal direction of the yarn carrier rails, as the shifting means and the yarn carrier are being engaged with each other by the engaging means, the yarn carrier will shift on the yarn carrier rail together with the shifting member. When the yarn carrier is caught and carried by the catching means of the cam carriage, as the engaging means allows relative shift between the yarn carrier and the shifting member, the yarn carrier will be able to shift on the yarn carrier rail without being restraint by the shifting member.

Preferably, in said engaging means, the shifting member and the yarn carrier are engaged by friction between, for example, a magnetic material and a magnet, and said friction is made greater than the friction between the yarn carrier and the yarn carrier rail. With his arrangement, when the shifting member shifts in the longitudinal direction of the yarn carrier rails, as the friction between the shifting member and the yarn carrier is greater than the friction between the yarn carrier and the yarn carrier rail, the yarn carrier will travel on the yarn carrier rail together with the shifting member. However, when the yarn carrier is caught and carried by the catching means of the cam carriage, the yarn carrier will be carried, against the friction, without being restraint by the shifting member.

Preferably, at least the body proper of the yarn carrier rail is made of a light metal.

The engaging means may be provided by a member for mechanically interlocking a yarn carrier with a shifting member, through, for example, engagement of teeth or pressing a contact piece against, and a member for undoing the interlocking when the yarn carrier is caught and carried by the cam carriage. With this arrangement, when the interlocking is undone when the yarn carrier is caught and carried by the cam carriage, the yarn carrier can be carried over without any friction between the yarn carrier and the shifting means.

Preferably, the shifting member comprises slide plates of a magnetic material being supported on the yarn carrier rails, extending in the longitudinal direction of the yarn carrier rails, and being shiftable in that direction, said engaging means includes magnets that are provided on surfaces of the yarn carriers facing said slide plates, and the yarn carriers are supported on the yarn carrier rails by means of rolling members such as rollers and ball bushings.

Furthermore, preferably, the shifting means comprises a rack provided on one end of a slide plate, a pinion that engages with said rack, and a motor for driving said pinion, said motor, for example, being fixed onto one end of the flat knitting machine.

Preferably, said shifting member comprises slide plates including a magnetic material, being supported on the yarn carrier rails, extending in the longitudinal direction of the yarn carrier rails, and being shiftable in that direction, said catching means comprises pins and solenoids for vertically moving the pins, the yarn carriers are supported on the yarn carrier rails by means of rolling members such as rollers and ball bushings, and said engaging means includes an engagement piece provided on the yarn carrier, a spring for pressing said engagement piece against the slide plate, and a swing shaft for swinging said engagement piece, and an arrangement is made in such a way that when the yarn carrier is caught and carried by said pin, the pin makes the engagement piece to swing, about said swing shaft, to move away from the slide plate. In this way, the catching and carrying by the pin disengages the engagement piece from the slide plate to undo the engagement between the yarn carrier and the slide plate, and when the catching and carrying is undone, the engagement piece will be pressed by the spring against the slide plate to make engagement.

Preferably, a means for adjusting the slide plate position during knitting on said flat knitting machine is provided, and, for example, it is judged, from the knitting program, whether adjustment of the slide plate position is needed or not, and if necessary, for example, when a yarn carrier that is related to the relevant slide plates is being caught and carried by the cam carriage, adjustment is made by shifting the slide plates so that the shifting range of the slide plates does not exceed the shiftable range thereof.

Preferably, said flat knitting machine is arranged in such a way that according to a knitting program the cam carriage reciprocates over the needle beds to effect knitting, a processing means is provided for determining, from said knitting program, the position of the shifting member after at least one round of the cam carriage from the present position over the needle beds and comparing said predicted position with the shiftable range of the shifting member stored in advance, and when said predicted position exceeds said shiftable range, said shifting member is shifted while the cam carriage is catching and carrying the yarn carrier.

In the yarn feeding system of a flat knitting machine according to the present invention, yarn carriers can be caught and carried by the cam carriage, and yarn carriers can be shifted by a shifting member such as slide plates and an endless belt as well. Hence small shifts of a yarn carrier may be done by a shifting member to reduce the burden of the cam carriage. Moreover, when the cam carriage catches and carries a yarn carrier, in contrast with the conventional yarn feeding systems, there is no need of synchronizing the shifting member with the cam carriage or giving an electric restraint. Furthermore, two or more yarn carriers may be attached to a shifting member, and the distances of these yarn carriers can be varied, and there is no need of providing a shifting member to every yarn carrier. Moreover, a yarn carrier can follow the shifting member to shift on the yarn carrier rail, and when a yarn carrier is released from the catching and carrying by the cam carriage, the yarn carrier will be halted by attraction to or engagement with the shifting member. When yarn carriers are supported on yarn carrier rails by using rolling friction, etc., the yarn carriers can be shifted easily.

When a combination of a magnetic material and a magnet is used, yarn carriers can be easily shifted by a shifting member. When a yarn carrier and a shifting member are uninterlockably engaged with each other by an interlocking means such as a spring, the yarn carrier will not slip even when the shifting member is made to shift at a high speed, and when the interlocking is undone, the yarn carrier can be caught and carried at low friction, and the halting position of the yarn carrier upon undoing of the catching and carrying can be controlled accurately.

When slide plates and the like are used as shifting members, the shifting range will be limited. In many cases, the first shift of the shifting member is a small movement such as a kick back, for example, one stitch to several stitches. When such shifts are accumulated, however, they may exceed the shiftable range of the shifting member. To cope with this problem, the position of the shifting member after at least one round of the cam carriage over the needle beds from the present position is determined. There may be small rounds of the cam carriage, such as kick backs of yarn carriers. These small rounds may be included in or excluded from the above-mentioned one round. Any movement of the cam carriage over the entire fabric must be included in the above-mentioned one round. If the position of the shifting member by the time point of completion of one round is within the allowable shiftable range, there will be no need of adjusting the shifting member. If the position of the shifting member after one round exceeds the allowable shiftable range, the shifting member will be shifted while the cam carriage is catching and carrying the relevant yarn carrier to bring the shifting member position after one round within the shiftable range.

When one shifting member is matched with one yarn carrier, the shifting member may be shifted when this yarn carrier is being caught and carried by the cam carriage. When one shifting member is matched with two yarn carriers, if adjustment is to be made to shift the shifting member to the right, the shifting member position will be adjusted while the right yarn carrier is being caught and carried by the cam carriage. The left yarn carrier will follow the movement of the shifting member to move to the left. When the cam carriage reverses to use the left yarn carrier, the carrier will start catching and carrying at a position a little shifted to the right. Similarly, if adjustment is to be made to shift the shifting member to the left, the shifting member position will be adjusted while the left yarn carrier is being caught and carried.

EMBODIMENTS

In the following, embodiments of the present invention will be described with reference to the attached drawings.

Figure 1:
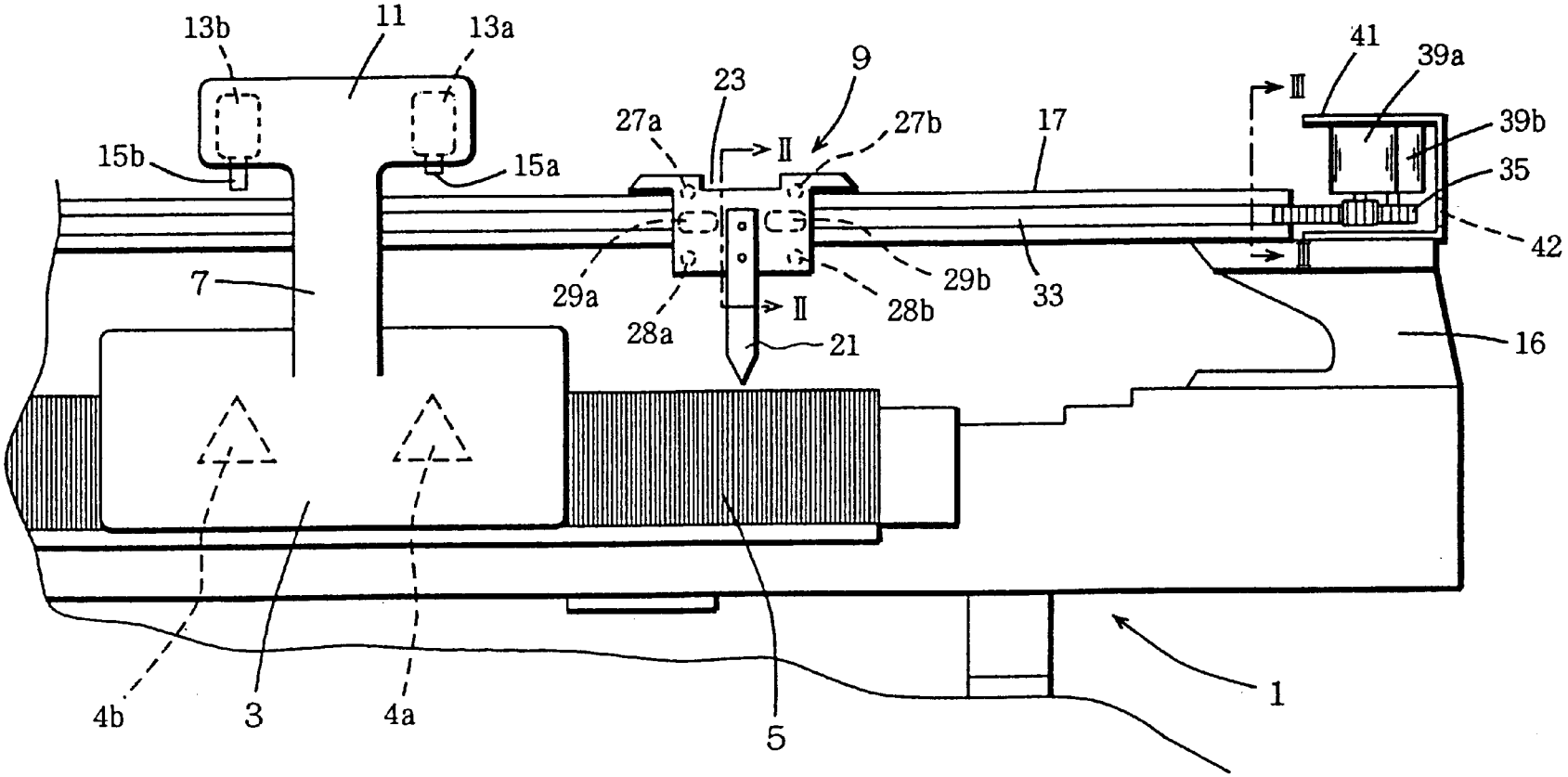
FIG. 1 shows the outline of a yarn feeding system of a flat knitting machine of one embodiment.
Figure 2:
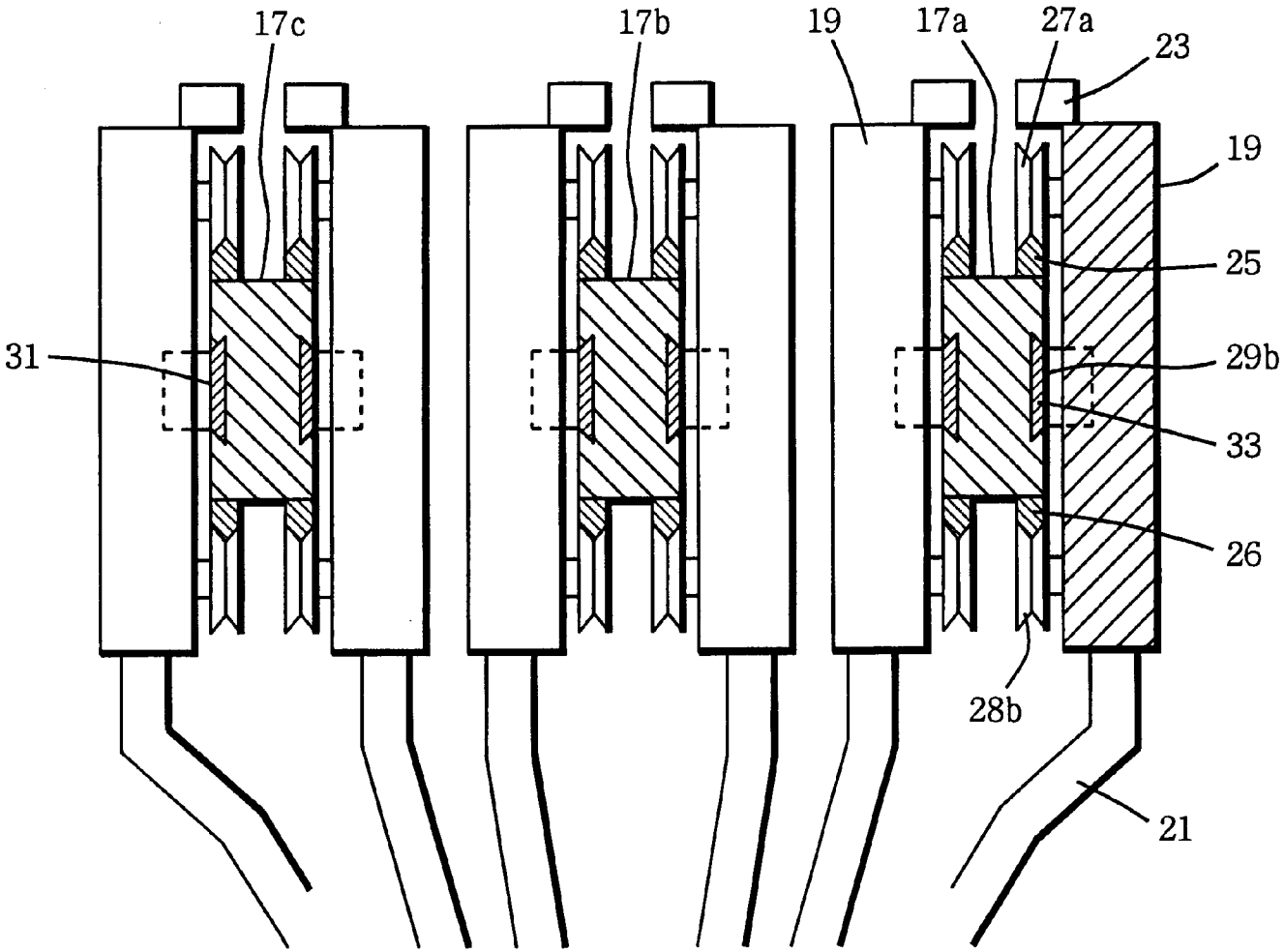
FIG. 2 shows the section along the line II—II of FIG. 1.

FIG. 1 shows a flat knitting machine 1 seen from the front thereof FIG. 2 shows the section along the line 11—II of FIG. 1. Mark 3 denotes a cam carriage. The cam carriage 3 is driven by a belt driving means, that is not illustrated, to reciprocate over one pair or two pairs of needle beds 5 to control, by means of knitting cams 4 facing the needle beds 5 from above, advancement and retraction of needles of the needle beds 5. The cam carriage 3 is provided with an arm gate 7 that straddles over the front and back needle beds, and the arm gate 7 is provided with a means 11 for catching and carrying yarn carriers 9. The catching and carrying means 11 is provided with many solenoids 13 and catching pins 15 that are moved vertically by the respective solenoids. Above the needle beds 5 are provided yarn carrier rails 17 between brackets 16 at both ends of the flat knitting machine. For example, three yarn carrier rails may be provided, and tracks for supporting and running yarn carriers 9 are formed on the front and the back of the respective yarn carrier rails 17*a*, 17*b* and 17*c*. In the flat knitting machine of the embodiment, two yarn carriers are mounted on one track of each yarn carrier rails. Hence twelve yarn carriers at the maximum can be used for knitting a fabric. A yarn rod 21 is mounted on the base 19 of each yarn carrier 9. The yarn rod 21 has a yarn feeder at the top end thereof. In the top of the base 19 is provided a recess 23 at the center. A catching pin 15 of the catching means 11 of the cam carriage 3 is made to dip into this recess 23 to engage with the base 19 to catch and carry the yarn carrier 9. Such a catching means of yarn carriers itself is publicly known through Japanese Patent Sho 62-29539.

The yarn carrier base 19 is provided, as rolling means, with two pairs of a right roller and a left roller, 27 and 28, in the upper part and the lower part and these rollers run over roller rails 25, 26 formed on the top and the bottom of each yarn carrier rail 17. In this way, yarn carriers 9 are supported on yarn carrier rails 17, and the rollers are prevented from coming off the yarn carrier rails, and yarn carriers move with low friction or rolling fiction. Dovetail grooves 31 are formed by grinding in each yarn carrier rail 17 over its entire length. A slide plate 33, being a shifting member, is movably inserted in the dovetail groove 31; thus the slide plate 33 is supported by the yarn carrier rail 17. The slide plate 33 is a strip of steel being a magnetic material, and is attracted by magnets 29 mounted on a surface of the base 19 of a yarn carrier 9, said surface facing the slide plate 33.

The yarn carrier 9 is supported on the yarn carrier rail 17 by supporting means that use rolling friction. To secure attraction between magnets 29 mounted on the base 19 and the slide plate 33, the yarn carrier rails 17 may be made of a nonmagnetic material such as aluminium and a reinforced plastic. Preferably, the yarn carrier rails 17 are made of a light metal such as aluminium and alloys containing aluminium. In the conventional flat knitting machines, as every yarn carrier is made to halt by sliding resistance between the yarn carrier and the yarn carrier rail, the yarn carrier is provided with two contact pieces in place of the rollers 27*a*, 28*b* of FIG. 2, and springs or the like are provided in the yarn carrier to press the two contact pieces against the yarn carrier rail. As a result, large forces are exerted to the yarn carrier rail by the yarn carrier. Hence the yarn carrier rail must be made of a material that is heavy and will not vibrate much. Steels such as S45C are used. In the present embodiment, however, when the yarn carrier is released from the catching and carrying by the cam carriage 11, the yarn carrier will be halted by the attraction to the slide plate 33. Hence friction between the yarn carrier rail 17 and the yarn carrier is not needed. Accordingly, the yarn carrier rails 17 can be made of light metals or the like. In FIG. 2, FIG. 3, FIG. 7 and FIG. 9, preferably, parts or portions that contact rollers or the like of the yarn carriers are made of steel for higher wear resistance as before. A secondary effect of this arrangement is reduction in weight relative to the conventional yarn carrier rail made of steel such as S45C.

Figure 3:
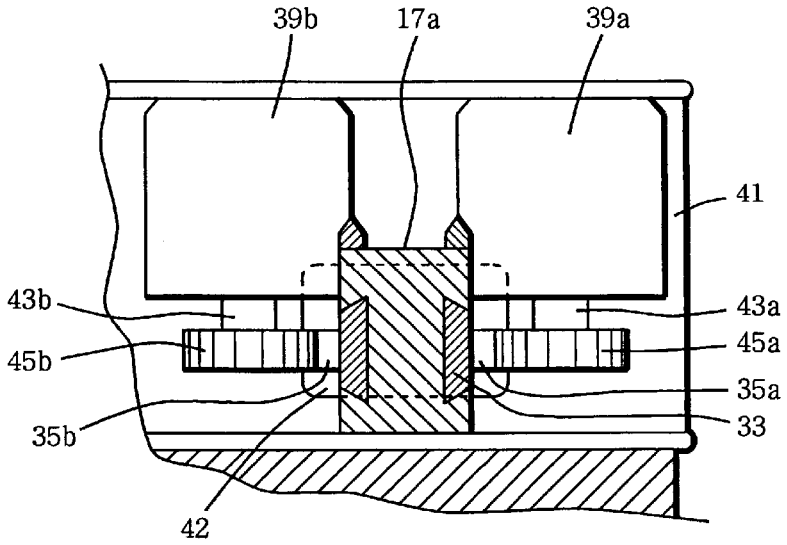
FIG. 3 shows the section along the line III—III of FIG. 1.

A rack 35 of a certain length is fixed to the right end of the slide plate 33. A servomotor 39 for driving the slide plate 33 of each track to slide is mounted, via a fixture 41, on the supporting bracket 16. A pinion 45 that interlocks with the gear of the rack 35 is mounted on the motor shaft 43 of the servomotor 39. When the motor shaft 43 of the servomotor 39 is rotated clockwise/counterclockwise, the slide plate will slide to the left/right FIG. 3 is a section along the line III—III of FIG. 1. It is a magnified view of portions related to the yarn carrier rail 17*a*. Mark 42 denotes an open hole that allows the rack to slide to the right beyond the motor fixture. In the present embodiment, the entire length of the rack 35 is about 140 mm, and the slide distances of the slide plate 33 to the left and to the right are limited by this length.

The attractive forces between the magnet 29 mounted on the yarn carrier 9 and the slide plate 33 is determined so that it is sufficient, even when the slide plate 33 is made to slide to the left or right by the servomotor 39, to make the yarn carrier 9 follow the movement of the slide plate 33 and shift without lagging, and the yarn carrier 9 can be caught and carried by a catching pin 15 against the sliding resistance caused by this attractive force, and the yarn carrier 9 can come to a halt quickly when it is released from the catching pin 15. The major requirement, however, is that the frictional resistance between the slide plate and the yarn carrier is greater than the frictional resistance between the yarn carrier and the yarn carrier rail. To increase the attractive force of the magnet, the magnet may be mounted on the base 19 by using a yoke. Preferably, to prevent slippage between the magnet and the slide plate, the initial acceleration of the servomotor should be moderate. In the yarn feeding system of the embodiment, the weight of the yarn carrier is about 150 g, the rolling load between the rollers of the yarn carrier and the yarn carrier rail is about 25 gf, the attractive force between the magnet and the slide plate is about 1 kgf, the weight of the slide plate is about 200 g, the sliding load between the yarn carrier rail and the slide plate is about 250 gf, the maximum speed of cam carriage is 1.5 m/s, and the pitch between knitting cams is about 4 inches. Further, the motor for driving the slide plate is a position feedback AC servomotor with output of 100 W, and the maximum acceleration of the slide plate is about 30~40 $m/s^2$.

Since the yarn feeding system of the present embodiment is constructed as described above, the yarn carrier 9 can be caught and carried by the catching pin 15 mounted on the cam carriage 3, and the yarn carrier can be carried by sliding the slide plate 33 as well. When the yarn carrier 9 is being caught and carried by the catching pin 15, the yarn carrier can be shifted freely against the attraction between the yarn carrier and the slide plate, and there is no need, in contrast with the conventional yarn feeding systems, of synchronizing the slide plate with the shift of the cam carriage or applying an electric restraint.

Figure 4:
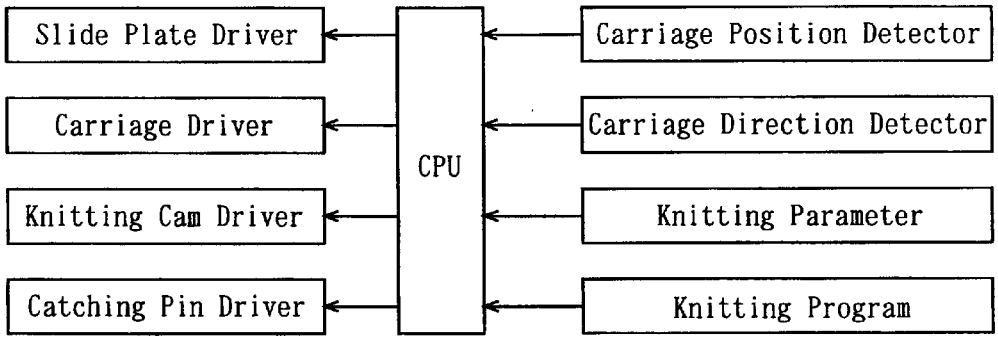
FIG. 4 is a block diagram of the controller of the embodiment

The schematic configuration of the controller of the flat knitting machine in the present embodiment is shown in FIG. 4. On the output side, there are a driver (servomotors 39, etc.) for reciprocatively slide the slide plates, a cam carriage driver for reciprocating the cam carriage over needle beds, a driver of knitting cam 46 for moving needles forward and backward including selecting needles, and a driver (solenoids 13) of the catching pins 15 that catch and carry yarn carriers. On the input side, there are a detector that detects the cam carriage position over the needle beds, a detector that detects the direction of movement of the cam carriage, a knitting parameter memory that stores pitches of knitting cams provided on the cam carriage and the slidable ranges of the slide plates, and a knitting program memory that stores the configuration of the fabric, the pattern and the control data. The CPU processes the signals from the detectors and the data of the memories to control the outputs of various parts.

[Intarsia Knitting]

Figure 5:
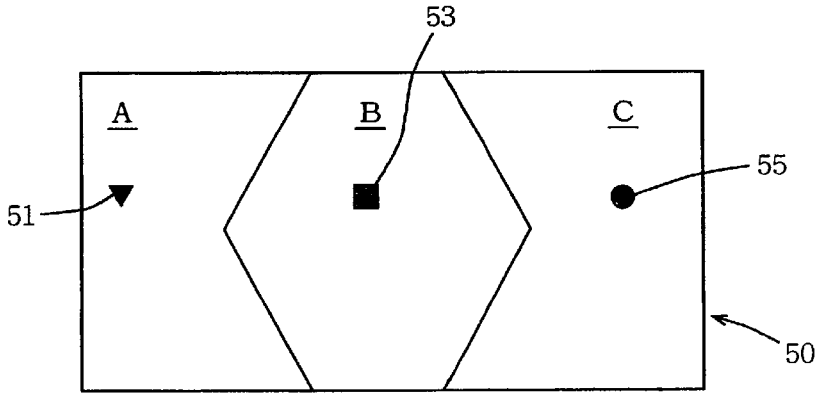
FIG. 5 shows a fabric having an intarsia pattern and yarn carriers used in knitting the respective fields thereof
Figure 6:
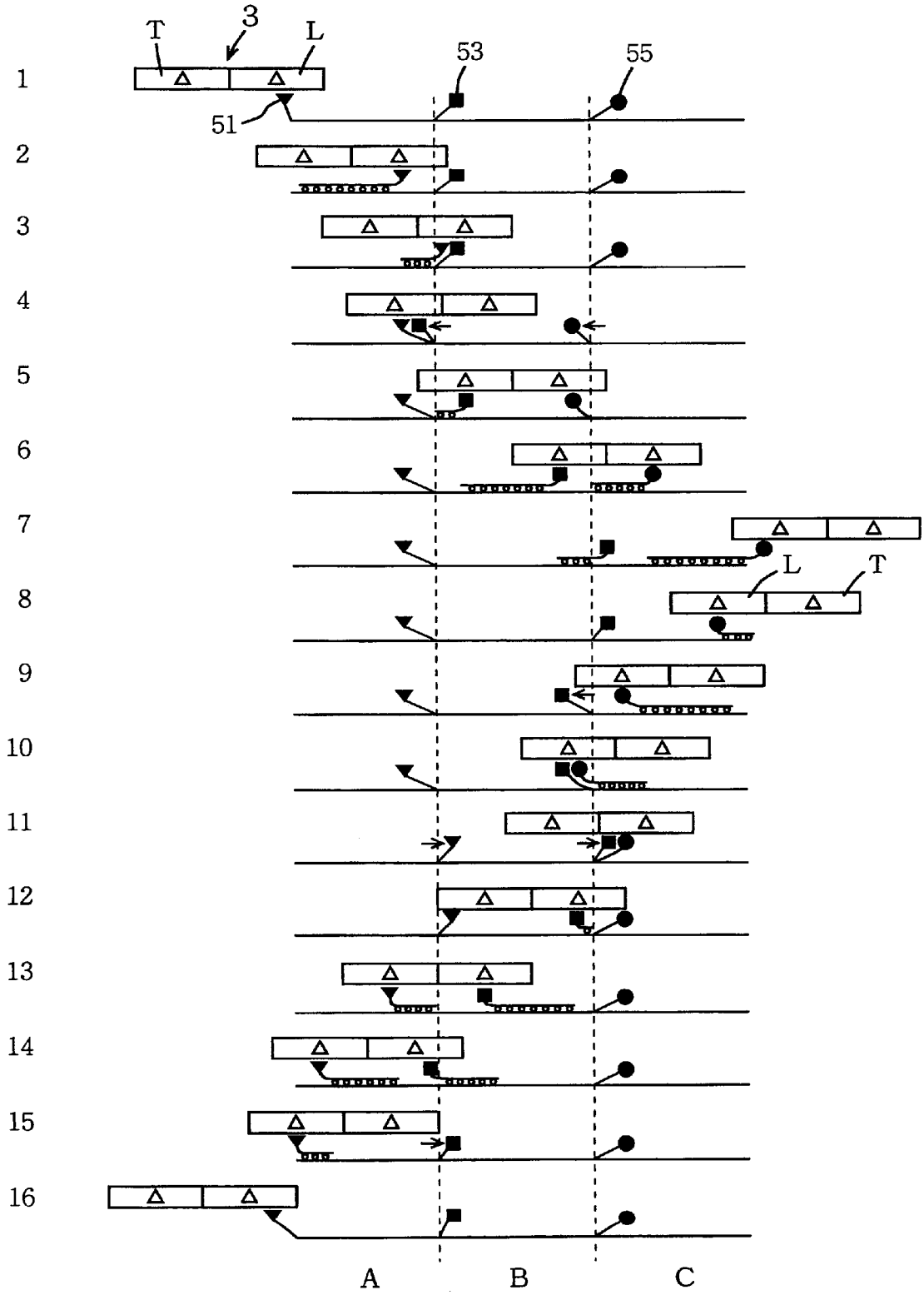
FIG. 6 shows the basic knitting of one round of the cam carriage for the intarsia fabric of FIG. 4, and 1 through 16 are knitting steps.

A case will be described wherein the yarn feeding system of the present embodiment is applied to knitting of a fabric 50 having a three-color intarsia pattern shown in FIG. 5. The intarsia pattern consists of three fields, A, B and C. There are six tracks. A yarn carrier 51 of the first track is assigned to the field A, and a yarn carrier 53 of the second track is assigned to the field B, and a yarn carrier 55 of the first track, that is the same track used for the field A, is assigned to the field C to knit the fabric. The cam carriage 3 has two knitting systems, and each knitting system is provided with knitting cams 4 that control the movements of needles, and with catching pins that catch, carry and release yarn carriers. The fields A and C are knit by the leading cam system (L) and the field B by the tailing cam system (T). In the traveling direction of the cam carriage 3, the system on the front is the leading cam system (L) and the system on the back is the tailing cam system (T). FIG. 6 shows in detail the basic knitting for one round of the cam carriage in intarsia knitting.

First, the step 1 shows that the cam carriage 3 is in the left of the fabric 50 and is traveling to the right. At this time, the yarn carriers 51, 53, 55 of the respective fields are stationary at the positions shown in the diagram. The step 2 shows that the yarn carrier 51 of the field A was caught and carried by the catching pin of the leading cam system (L) to form halfway a stitch course of the field. The subsequent step 3 shows that the stitch course of the field A is completed, and the yarn carrier 51 is released from the catching pin.

The step 4 shows shifts of the yarn carriers 51, 53 to prepare for the knitting of the field B by the tailing cam system (T). These shifts are made after the leading cam system (L) knits the stitch course of the field A and before the tailing cam system (T) reaches the catching position of the yarn carrier 53 of the field B. The slide plate of the second track is slid by a certain amount, for example, 30 mm, to the left to bring the yarn carrier 53 to the left of the field B. At the same time, the slide plate of the first track is slid to the left to bring the yarn carrier 51 back to the field A and the yarn carrier 55 is shifted into the field B.

The step 5 shows that the tailing cam system (T) has halfway formed the stitch course of the field B. The step 6 shows that the cam carriage has advanced further and the knitting of the field C has been started by the leading cam system (L). The step 7 shows that the knitting of the fields B, C is completed and the yarn carriers 53, 55 have been released and the cam carriage is just before reversing. The step 8 shows that the cam carriage has advanced to the left and the leading cam system (L) has carried the yarn carrier 55 of the field C to form the stitch course halfway.

The step 9 shows a shift of the yarn carrier 53 of the field B, that is standing in the left of the field C. Before the yarn carrier 53 becomes an obstacle to formation of a stitch course of the field C by the leading cam system (L), the slide plate of the second track is slid to the left to shift the yarn carrier 53 into the field B. The step 10 shows that the formation of the stitch course of the field C is completed and the yarn carrier has been released. The step 11 shows the preparation for knitting of the field B by the tailing cam system (T); the yarn carriers 53, 55 that stand in the field B are moved into the field C. With the shift of the yarn carrier 55 of the field C, the yarn carrier 51 of the filed A is also shifted. This shift is effected by sliding the slide plates of the first and second tracks to the right before the arrival of the tailing cam system (T). The step 12 shows that the formation of a stitch course of the field B has been started by the tailing cam system (T). The step 13 shows the continued knitting of the field B and the formation of a stitch course of the field A by the leading cam system (L). The next step 14 shows that the knitting of the filed B by the tailing cam system (T) is completed and the yarn carrier 53 has been released from the catching pin. In the step 15, the slide plate of the second track is slid to the right to shift the yarn carrier 53 of the field B, that stands in the field A, into the field B. The step 16 shows that the knitting of the field A is completed and the cam carriage is immediately before reversing. When knitting of the above-mentioned step 1 through step 16 is repeated, the fabric of the intarsia pattern shown in FIG. 5 will be knitted.

When the yarn feeding system of the embodiment is operated as described above, an intarsia fabric can be knitted with high efficiency. When the slide strokes of the sliding means are short as is the case with the present embodiment, adoption of a combination of a rack and a pinion will simplify the configuration of the system. Such kick backs with small shifts of yarn carriers are used in knitting of various fabrics including the above-mentioned intarsia patterns.

In contrast with the conventional yarn feeding systems, wherein yarn carriers are fixed at certain positions on driving belts, in the present invention yarn carriers are engaged in such a way that each yarn carrier can be shifted to any desired position on the slide plate. Accordingly, even when two yarn carriers are mounted on the same track, these yarn carriers can be shifted and the distance between these yarn carriers can be changed. With this arrangement, it is possible to use yarn carriers 51, 55 mounted on the same track to knit a pattern in which the knitting width between the field A and the field C is varied. In the conventional yarn feeding systems, it was necessary to provide the same number of servomotors, driving belts, etc. as the number of yarn carriers to be used. The present embodiment has a merit that one slide plate can be used for plural yarn carriers.

[Modification 1]

As a modification of the shifting means, an endless belt is put across pulleys mounted on both ends of a yarn carrier rail, and one pulley is driven to rotate by a servomotor. This modification is identical to the above-mentioned embodiment except that a flexible belt containing a magnetic material is stuck on the entire circumference of the endless belt so that it mutually attracts with magnets of yarn carriers. In place of the above-mentioned method, the endless belt may be produced by mixing a magnetic material powder into the raw materials of the belt, or small pieces of a magnetic material may be tightly stuck over the entire outer circumference of an endless belt. In the yarn feeding system of this modification, the stroke of a shift of a yarn carrier that is effected by the shifting means is free of the restraint of the above-mentioned embodiment: for example, a yarn carrier can be shifted from the right end to the left end of the needle bed.

[Modification 2]

Figure 7:
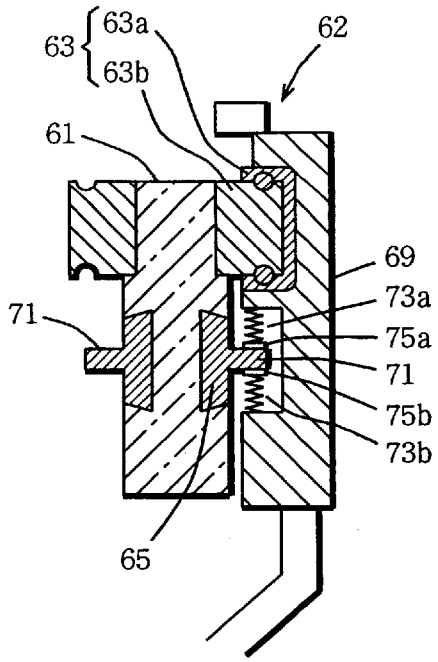
FIG. 7 is a diagram corresponding to FIG. 2, of a yarn feeding system of the modification 2.

FIG. 7 shows the modification 2. In this yarn feeding system, each yarn carrier 62 is supported on a yarn carrier rail 61 by rolling friction, through, for example, a steel ball bushing 63 of a bearing. A movable part 63*a* of the ball bushing is fixed onto the base 69 of the yarn carrier 62, and the fixed part 63*b* is mounted on the yarn carrier rail side. Mark 65 denotes a slide plate that is provided in parallel with the yarn carrier rail 61. A protrusion 71, that protrudes towards the base 69 of the yarn carrier 69, is formed on the slide plate 65 over its entire length. The yarn carrier base 69 facing this protrusion 71 is provided with a pair of springs 73*a*, 73*b* to pinch the protrusion 71 from the above and the below. Contact pieces 75*a*, 75*b* are provided on the top ends of these springs. The contact pieces 75 press against the protrusion 71 of the slide plate 61 due to the elastic forces of the springs 73 and generate the sliding resistance between the yarn carrier and the slide plate. Like the above-mentioned embodiment, the slide plate 61 is provided with a rack at one end thereof in the longitudinal direction, and is driven to slide by a servomotor using a rack-pinion system.

This sliding resistance is adjusted so that when the slide plate 61 is driven to slide to the left or right by the servomotor of the sliding means, this sliding resistance prevents slippage between the yarn carrier 62 and the slide plate 61, that the catching pin can catch and carry the yarn carrier against the sliding resistance, and the yarn carrier quickly comes to a halt when it is released from the catching pin. The yarn carrier is constantly subjected to the friction due to these springs, and is caught and carried by a catching pin or is made to slide by the sliding means.

In the respective embodiments mentioned above, each yarn carrier is given a sliding resistance (engagement) against a slide plate or an endless plate being a shifting member, and the yarn carrier is caught and carried by a catching and carrying means of the cam carriage against the sliding resistance between the yarn carrier and the shifting member. Thus the configuration of the engaging means of the yarn feeding system is simplified, and braking is applied to the yarn carrier when it is released from the catching pin.

[Embodiment 2]

Figure 8:
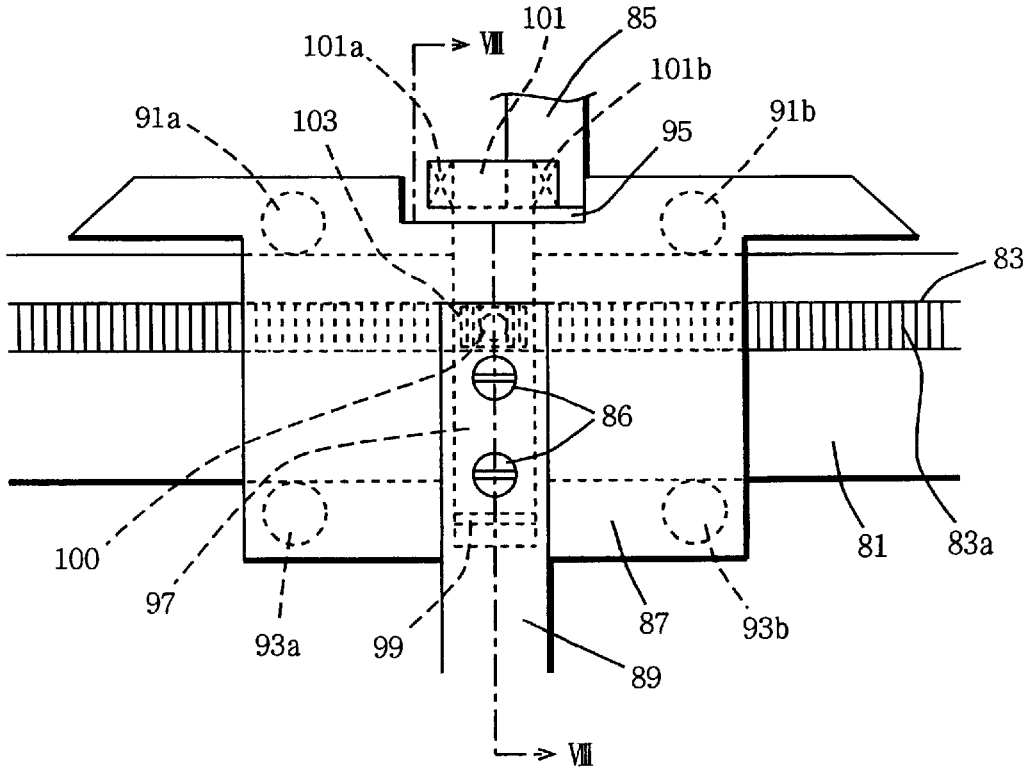
FIG. 8 shows a part of a yarn feeding system of another embodiment
Figure 9:
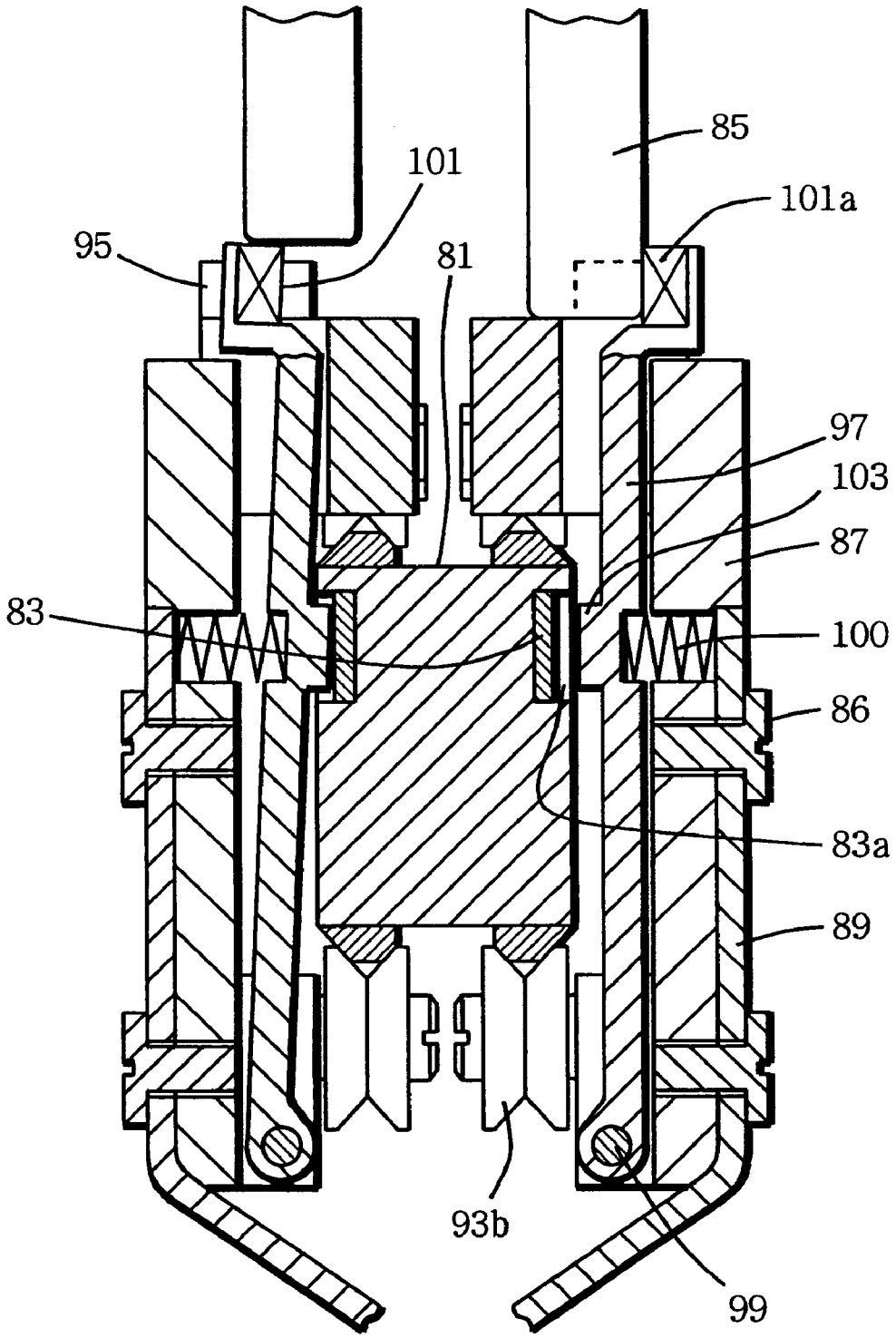
FIG. 9 shows the section along the line VIII—VIII of FIG. 8.

Another embodiment of the yarn feeding system of the present invention is shown in FIG. 8 and FIG. 9. In this embodiment, is provided a means for undoing the engagement of an engaging means for engaging a yarn carrier with a shifting member such as a slide plate. When the cam carriage catches and carries a yarn carrier with a catching pin, the undoing means undoes the engagement effected by the engaging means. When the yarn carrier is released from the catching pin, the yarn carrier is made to engage with the shifting member by the engaging means. Any particulars of which explanation is omitted in the following should be similar to those of the above-mentioned embodiment.

In the diagrams, the mark 81 denotes a yarn carrier rail, 83 a shifting member, 85 a catching pin, 87 a yarn carrier base, 89 a yarn rod, 91 and 93 rollers, and 86 setscrews, respectively. The mark 95 denotes a recess that is formed in the top of the yarn carrier base to receive the catching pin 85.

Attention should be given to the following points. Teeth 83*a* are formed on the surface of the shifting member 83 such as an endless belt and a slide plate. On the yarn carrier side, is provided a lever 97 having teeth 103 facing the teeth 83*a*, and the lever 97 is swingably supported on a transverse pin 99 in the lower part of the base 87. The lever 97 is energized by an energizing means such as a spring 100 so that the teeth 103 engage with the teeth 83*a* of the shifting member 83. When the engaging means is arranged in this way, when the yarn carrier is not caught and carried by the catching and carrying means of the cam carriage, the yarn carrier and the shifting member mechanically engage with each other, and even if the shifting member is shifted at a high speed, the yarn carrier will be able to follow the shifting member without slippage.

A cam 101 protruding to the side of the yarn carrier rail 81 is formed on the top of the lever 97, and a catching pin 85 of the cam carriage dips into the recess 95 to catch and carry the yarn carrier. At this time, against the energizing force of the spring 100, the catching and carrying pin 85 will push the cam 101 to move away from the yarn carrier rail 81 and swing the lever 97 to undo the engagement between the teeth formed on the lever 97 and the teeth 83*a* of the shifting member 83. In this condition, the yarn carrier is caught and carried. Marks 101*a* and 101*b* denote cam slopes for guiding the catching pin, and these cam slopes are formed on both sides of the cam. In this way, the engagement by the engaging means is undone when the yarn carrier is caught and carried. Accordingly, when the yarn carrier is caught and carried by a catching pin of the cam carriage, the friction between the shifting member and the yarn carrier is eliminated, and when the catching and carrying by the catching pin is undone, the halting position of the yarn carrier can be controlled accurately by the engagement with the spring 100.

When a rack-and-pinion system is used to shift a slide plate, if shifts of the slide plate are one-sided to the left or to the right, these one-sided shifts may integrate to exceed the slide stroke. This is not limited to the use of a rack and a pinion. This is due to the limited slide stroke, and can happen when the slide plate is shifted by a ball screw or the like. This problem is solved by adjusting the slide plate position during knitting.

Figure 10:
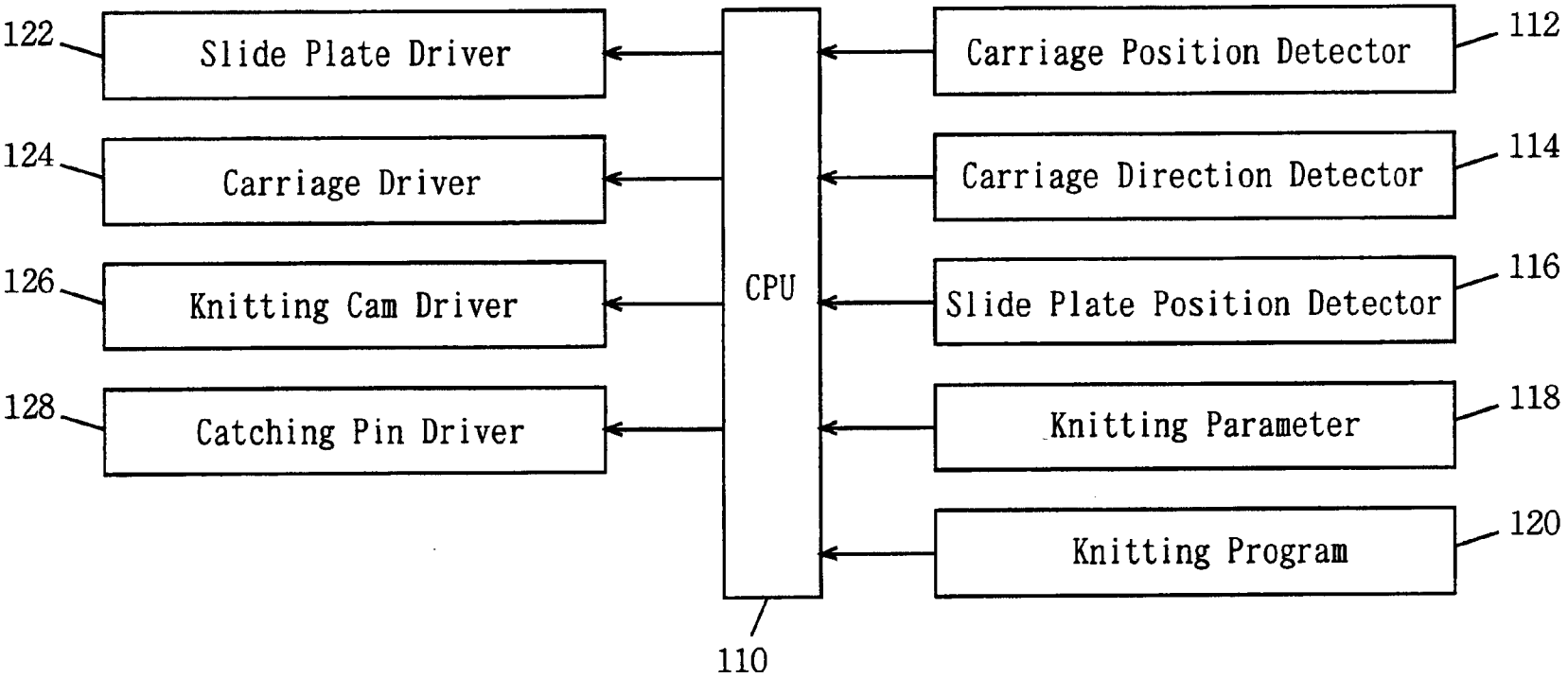
FIG. 10 is a block diagram that shows driving of the slide plates.
Figure 11:
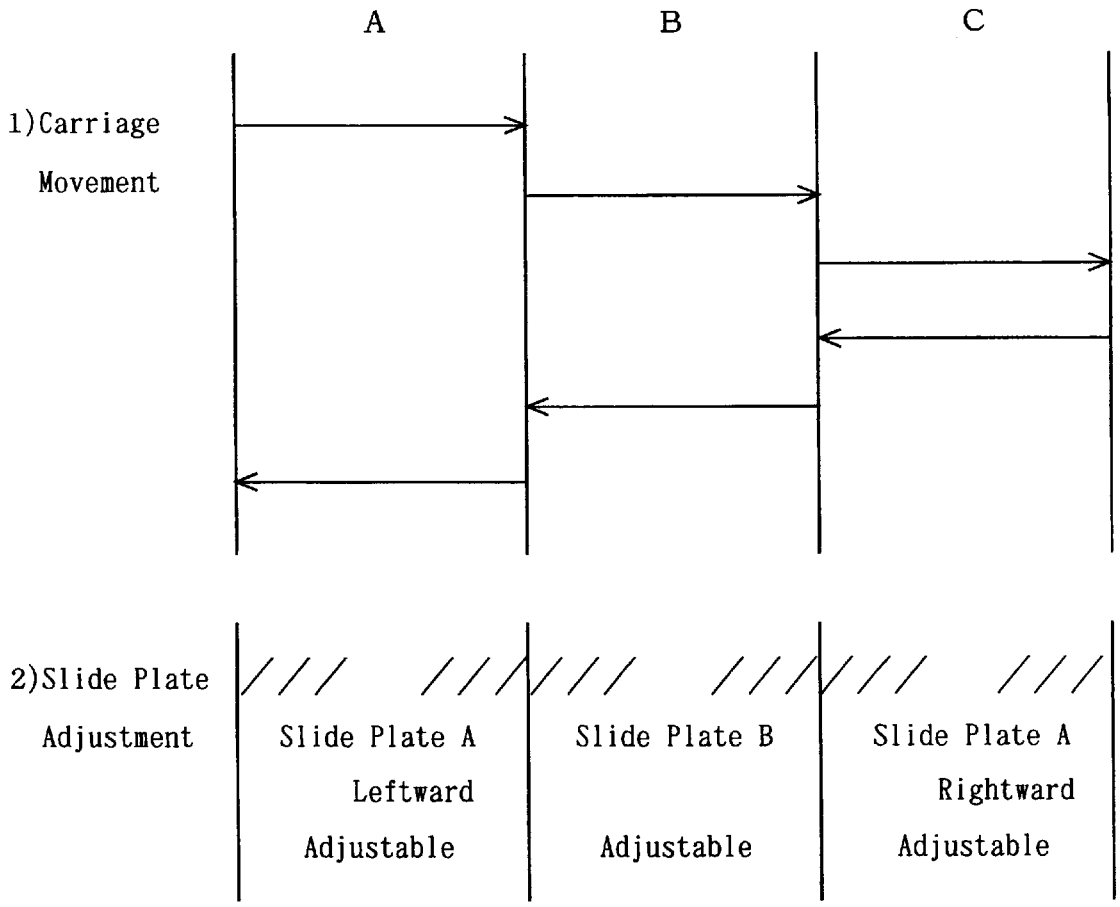
FIG. 11 is a diagram that shows the carriage movement and the timing of position adjustment of slide plates; 1) shows the carriage movements, and 2) shows the timing of position adjustment of the slide plates.
Figure 12:
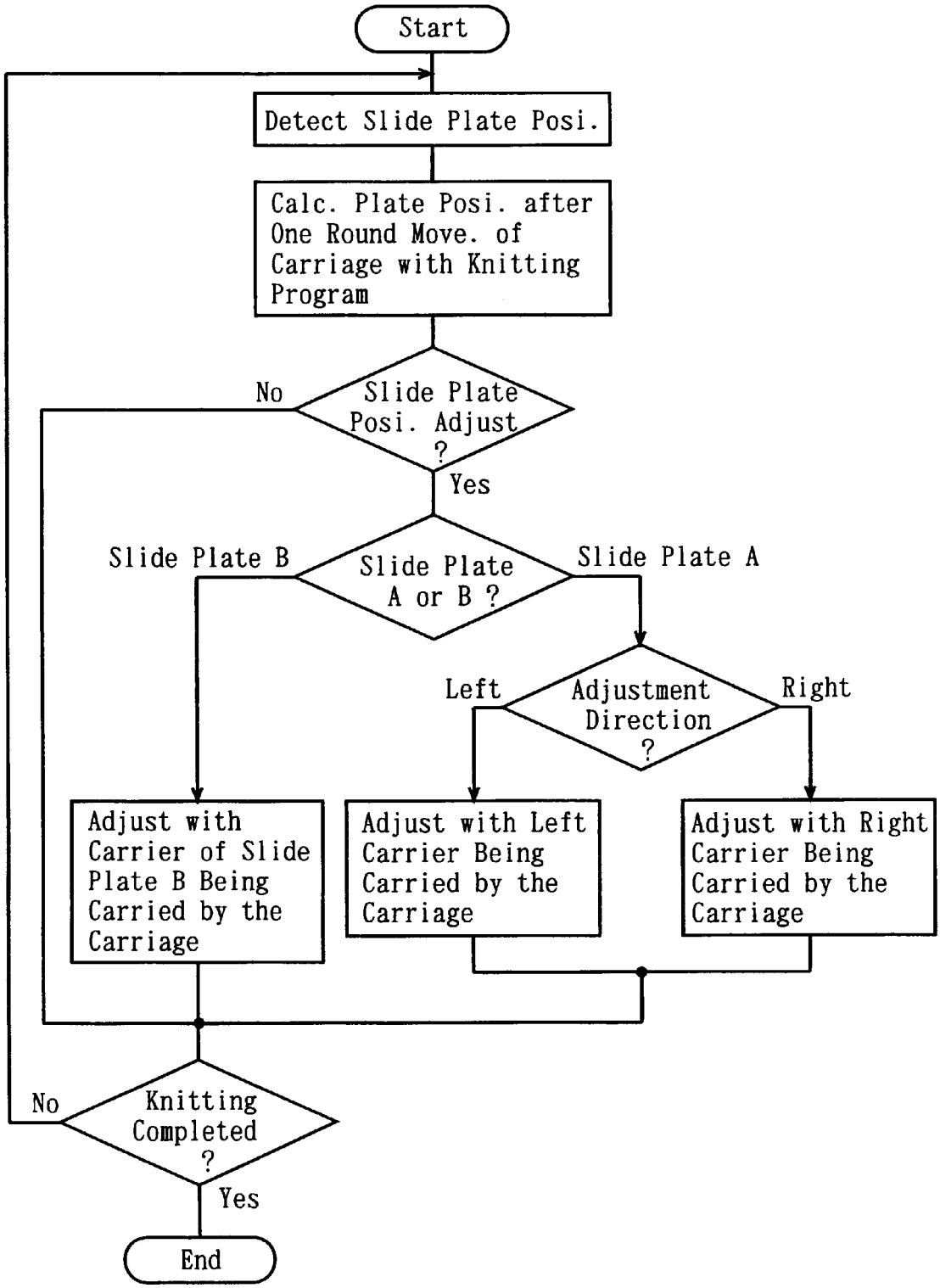
FIG. 12 is a flow chart that shows the position adjustment algorithm of the slide plates.

FIG. 10 through FIG. 12 show adjustment of the slide plate. FIG. 10 schematically shows the configuration of the controller of the flat knitting machine. On the input side, 112 is a cam carriage position detector, 114 is a cam carriage direction detector, 118 is a knitting parameter store, and 120 is a knitting program store. They are identical to those shown in FIG. 4. 116 is a slide plate position detector. For example, it integrates the rotations of the servomotor from the beginning of knitting to detect the present position of the slide plate. On the output side, 122 is a slide plate driver, 124 is a cam carriage driver, 126 is a knitting cam driver, and 128 is a catching pin driver. They are identical to those shown in FIG. 4.

FIG. 11 shows the movement of the carriage during the intarsia knitting of the embodiment and the timing of adjustment of the slide plate position. There are two yarn carriers on the slide plate A, and the field A is knitted by the left yarn carrier, and the field C by the right yarn carrier. There is one yarn carrier on the slide plate B, and the field B is knitted by that yarn carrier. Here, the cam carriage moves sequentially from the top towards the bottom of 1), and the arrows indicate the shifting directions. A, B and C are three fields of the intarsia knitting. 2) shows that when the cam carriage is knitting the field A, the position of the slide plate A can be adjusted leftward, that when the cam carriage is knitting the field B, the position of the slide plate B can be adjusted either leftward or rightward, and that when the cam carnage is knitting the field C, the position of the slide plate A can be adjusted rightward. It should be noted that when yarn carriers are shifted by the slide plate, if the leftward shift and the rightward shift are symmetrical, the leftward shift of the slide plate and the rightward shift thereof cancel each other, and in principle no adjustment of the slide plate position is required. This applies, however, to the cases where the slide plate A controls two yarn carriers.

When one slide plate controls one yarn carrier, it is sufficient to adjust the slide plate position when the cam carriage is catching and carrying the relevant yarn carrier. FIG. 11 also assumes that due to repetition of kick backs of the yarn carriers, large modifications of knitting widths of the respective fields, etc., modification of the slide plate positions is needed.

As the slide plate B has a single yarn carrier, the slide plate B can be adjusted either leftward or rightward provided the yarn carrier is being caught and carried by the cam carriage. As for the slide plate A, rightward adjustment (rightward shift of the slide plate) is made when the right yarn carrier of the field C is being caught and carried by the cam carriage, and leftward adjustment is made when the left yarn carrier is being caught and carried by the cam carriage. When adjustment is made in this way, the yarn carrier that is not being caught and carried by the cam carriage will shift together with the slide plate A. However, when adjustment is either leftward or rightward, the yarn carrier that shifts together with the slide plate will shift towards the inner side of the fabric comprising the field A through the field C, and can be caught and carried by the cam carriage before the next knitting step, giving no adverse effects on the subsequent knitting.

As the adjustment of slide plate position is made while the cam carriage is catching and carrying one yarn carrier, when the shifting direction of the cam carriage and the adjustment direction are identical, the shifting speed of the slide plate is set lower than the speed of the cam carriage. When the shifting direction of the cam carriage is opposite to the adjustment direction, there is no restraint.

FIG. 12 is a flowchart of slide plate position adjustment. At the start of knitting, the center of the rack is in contact with the pinion, and the slide plate can be shifted either rightward or leftward by one half of the overall length of the rack. First, the CPU 110 receives the present slide plate position data from the slide plate position detector 116, and uses the knitting program to calculate the slide plate position after one round of the cam carriage over the entire fabric or after one round of the cam carriage to the present position. When the calculated result exceeds one half of the overall length of the rack, adjustment is needed. In this case, if the slide plate that needs adjustment is the slide plate B, the slide plate driver 122 is directed to make adjustment while a yarn carrier on the slide plate B is being caught and carried by the cam carriage. If the slide plate to be adjusted is the slide plate A, the adjustment process depends on the direction of adjustment. When the adjustment is leftward, the slide plate driver 122 is directed to make adjustment while the left yarn carrier is being caught and carried by the cam carriage. When the adjustment is rightward, the slide plate driver 122 is directed to make adjustment while the right yarn carrier is being caught and carried by the cam carriage. When the above-mentioned steps are repeated till the completion of knitting, the fabric will be knitted while the slide plates do not exceed the slide stroke.

Intarsia knitting is used as an example of knitting by the use of the yarn feeding system of the present invention, but knitting is in no way limited to it. According to the present invention, idle operations of the cam carriage are avoided by shifting the yarn carriers by the shifting means and the shifting member to achieve efficient knitting. In the above-mentioned examples, the shifting means of the yarn carriers are servomotors. However, when high speed shift of yarn carriers is not required, stepping motors may be used. Moreover, cylinders may be used as shifting means. The slide plates were moved by a rack and a pinion, but they may be shifted by ball screw, etc.

I claim:

1. A yarn feeding system of a flat knitting machine comprising needle beds with many needles, a plurality of yarn carrier rails extending in parallel to said needle beds and in a longitudinal direction of said needle beds, a cam carriage reciprocating over said needle beds, and yarn carriers caught/released by yarn carrier catching means mounted on said cam carriage to travel on a yarn carrier rail to feed yarn to the needles of said needle beds, said yarn feeding system being characterized by shifting members extending along and shiftable in the longitudinal direction of the yarn carrier rails;

shifting means for reciprocally shifting said shifting members in the longitudinal direction of the yarn carrier rails; and engaging means for engaging the yarn carriers to the shifting member, wherein the yarn carriers are disengaged and released from the shifting members when catching and carrying is effected by said catching means.

2. A yarn feeding system of a flat knitting machine of claim 1 being characterized in that in said engaging means, the shifting member and the yarn carriers are engaged by friction and said friction is made greater than the friction between the yarn carriers and the yarn carrier rails.

3. A yarn feeding system of a flat knitting machine of claim 2 being characterized in that at least a body proper of said yarn carrier rail is made of a light metal.

4. A yarn feeding system of a flat knitting machine of claim 2 being characterized in that said engaging means comprises a shifting member made of a magnetic material and a magnet of the yarn carrier.

5. A yarn feeding system of a flat knitting machine of claim 1 being characterized in that the yarn carriers are supported on the yarn carrier rails by rolling members.

6. A yarn feeding system of a flat knitting machine of claim 1 being characterized in that said engaging means is provided by a member for mechanically interlocking a yarn carrier with a shifting member, and a member for undoing the interlocking.

7. A yarn feeding system of a flat knitting machine of claim 1 being characterized in that said shifting member comprises slide plates of a magnetic material being supported on the yarn carrier rails, extending in the longitudinal direction of the yarn carrier rails, and being shiftable in that direction, said engaging means includes magnets that are provided on surfaces of the yarn carriers facing said slide plates, and the yarn carriers are supported on the yarn carrier rails by means of rolling members.

8. A yarn feeding system of a flat knitting machine of claim 7 being characterized in that said shifting member comprises a rack provided on one end of a slide plate, a pinion that engages with said rack, and a motor for driving said pinion.

9. A yarn feeding system of a flat knitting machine of claim 7 being characterized in that a means is provided for adjusting a slide plate position of the slide plates during operation of the yarn feeding system.

10. A yarn feeding system of a flat knitting machine of claim 1 being characterized in that said shifting member comprises slide plates including a magnetic material, being supported on the yarn carrier rails, extending in the longitudinal direction of the yarn carrier rails, and being shiftable in that direction, said catching means comprises pins and solenoids for vertically moving the pins, the yarn carriers are supported on the yarn carrier rails by means of rolling members, and said engaging means includes an engagement piece provided on the yarn carrier, a spring for pressing said engagement piece against the slide plate, and a swing shaft for swinging said engagement piece, and an arrangement is made in such a way that when the yarn carrier is caught and carried by said pin and the pin makes the engagement piece to swing, about said swing shaft, to move away from the slide plate.

11. A yarn feeding system of a flat knitting machine of claim 1, wherein said flat knitting machine is adapted to be arranged in such a way that according to a knitting program the cam carriage reciprocates over the needle beds to effect knitting, and has a processing means for determining, from said knitting program, the position of the shifting member after at least one round of the cam carriage from the present position and comparing said predicted position with the shiftable range of the shifting member stored in advance, and being characterized in that when said predicted position exceeds said shiftable range, said shifting member is shifted while the cam carriage is catching and carrying the yarn carrier.

* * * * *